United States Patent [19]

Wakamatsu et al.

[11] 4,390,135

[45] Jun. 28, 1983

[54] BAG REMOVAL APPARATUS

[75] Inventors: Atsuyuki Wakamatsu, Shimizu; Keisuke Tonooka, Shizuoka, both of Japan

[73] Assignee: Daiwa Can Company, Limited, Tokyo, Japan

[21] Appl. No.: 228,085

[22] Filed: Jan. 26, 1981

[30] Foreign Application Priority Data

Mar. 28, 1980 [JP] Japan ..... 55-41017[U]

[51] Int. Cl.[3] ..... B02C 18/16

[52] U.S. Cl. ..... 241/101.2; 83/435; 83/924; 241/274; 414/411

[58] Field of Search ..... 241/101 A, 101.2, 101.5, 241/274; 83/435, 924; 53/384, 492; 414/403, 411, 412

[56] References Cited

U.S. PATENT DOCUMENTS

| | | | |
|---|---|---|---|
| 2,133,311 | 10/1938 | Shuman | 414/411 |
| 3,596,842 | 8/1971 | Barber | 414/412 X |
| 4,002,255 | 1/1977 | Fincham et al. | 83/435 |

*Primary Examiner*—Howard N. Goldberg
*Attorney, Agent, or Firm*—Daley & Brandt

[57] ABSTRACT

A bag removal apparatus provided with a plurality of cutting assemblies, each cutting assembly consisting of cutting auxiliary rolls and a cutter for facilitating post-treatment of a paper bag by releasing the paper bag from a paper bag envelope encasing a long article and shredding the paper bag.

16 Claims, 3 Drawing Figures

BAG REMOVAL APPARATUS

BACKGROUND OF THE INVENTION

This invention relates to an apparatus for removing a bag from an article enclosed by the bag.

Apparatus according to the present invention may be utilized, for example, in the canning industry to remove an elongated paper bag from a long, cylindrical stack of can covers preparatory to use of the can covers in a canning operation. Ordinarily, before any such bag is removed from the stack of can covers enclosed therewith, the bag is slit longitudinally.

Prior to the present invention, apparatus such as that depicted schematically in FIG. 1 has been utilized for removing bags from stacks of can covers. The FIG. 1 apparatus includes a pair of horizontal, parallel arranged shafts 1 and 1' and two cylindrical support rolls 2 and 2' mounted on the shafts. Rolls 2 and 2' are covered with a resilient material and such rolls define a nip 7 therebetween. A pair of positioning rods 3 and 3' are disposed above the support rolls and extend parallel thereto. A bag Z enclosing an enlongated article A may be placed atop support rolls 2 and 2' between positioning rods 3 and 3' so that the bag rests on the support rolls, the long axes of the bag and article extending parallel to the support rolls. Normally, the bag is positioned so that the slit is at the top. A U-shaped pressure member 4 is forced downwardly onto the bag and article so that the lower portions 5 and 5' of the pressure member engage the bag and the article. As the article is forced downwardly by the pressure member, it in turn forces the lower portions of the bag overlying support rolls 2 and 2' into engagement with the support rolls at contact lines 6 and 6'. Support roll 2 is rotated in the clockwise direction as seen in FIG. 1 and support roll 2' is rotated in the counterclockwise direction. Such rotation of the support rolls draws the bag into the nip between the rolls and pulls it away from the article. As the bag is pulled away from the article, it is fed through the nip 7 and discharged from the apparatus onto a belt conveyor (not shown) which transports the bag to a storage container. The article A remains atop the support rolls when the bag is pulled away from it. After the bag is removed from the article, the article can be removed from the apparatus for further processing.

The bag may have thick, folded portions at its ends. Such portions generally are not pulled away from the article during the initial stages of the removal procedure. Rather, the midsection of the bag remote from the thick portions is fed into the nip 7 between the support rolls first. Once the midsection of the bag is firmly engaged between the support rolls in the nip, continued rotation of the support rolls feeds the midsection through the nip and pulls the thick portions at the ends of the bag into the nip. The end portions of the bag generally advance through the nip at different times. If one such end portion is thicker than the other, the thicker end portion will generally be fed through the nip last. Accordingly, the bag does not advance through the nip uniformly. Instead, the misection of the bag generally advances through the nip first, followed by one end of the bag and then the other end.

This nonuniform advancement of the bags through the nip between the support rolls may cause difficulties when the bags fall onto the belt conveyor. The first portion of a bag to pass through the nip may encounter the moving belt of the conveyor before the last portion of the bag has cleared the nip. Accordingly, the bags may be bent or stretched unpredictably as they encounter the conveyor belt, and the bags may be deposited on the conveyor belt in unpredictable orientations. Portions of some of the bags may project beyond the lateral margins of the conveyor belt and become entangled with other portions of the apparatus, causing a jam of bags on the conveyor. Moreover, because the bags are oriented at random on the conveyor belt, the bags will be fed into the storage container at random and stored therein in a random stack. Such random stacking wastes space within the storage container, especially when the bags are rather long (e.g., about 90 cm. long). Therefore, the storage container must be changed at frequent intervals during operation of the apparatus.

In some installations, the belt conveyor must make a right angle bend to accommodate space limitations in the building where the apparatus is used. The long bags can cause difficulties at such a bend in the conveyor.

Also, it is sometimes difficult to attain adequate frictional engagement between the bag and the support rolls at the lines of contact 6 and 6' in the apparatus shown in FIG. 1. The axes $0_1$ and $0_2$ of the support rolls are close to one another so that the angle $\theta$ subtended by imaginary planes $\overline{00_1}$ and $\overline{00_2}$ at the center 0 of article A is small. This arrangement of the support rolls limits the forces which will be applied to urge the bag against the support rolls at the lines of contact 6 and 6'. With the arrangement of rollers illustrated in FIG. 1, the sum of such forces generally will not be substantially greater than the downward force applied by pressure member 4. This downward force in turn is limited by structural considerations. If the downward force applied by the pressure member is too great, the support rolls and shafts can be bent and the article in the bag can be damaged. However, if the forces applied to urge the bag against the support rolls at contact lines 6 and 6' are not great enough, the frictional engagement of the bag with the support rolls may be inadequate to pull the bag away from the article.

SUMMARY OF THE INVENTION

The present invention provides a bag removal apparatus which alleviates the difficulties described above.

Apparatus according to the present invention may include a frame and a pair of elongated support rolls mounted to the frame. The rolls may be substantially horizontal, parallel to one another, but remote from one another so that they define a gap therebetween. The width of such gap should be less than the width of the article encased in the bag so that the support rolls will support the article and the bag when the article and the bag are disposed atop the support rolls. Means for urging the article downwardly to engage portions of the bag with the support rolls and means for rotating the support rolls relative to the frame about their respective axes may be provided. As the support rolls are rotated, they pull the bag away from the article and feed it through the gap.

As will be described in greater detail below, the arrangement of the support rolls remote from one another permits the article and the bag to be wedged between the support rolls when the article and the bag are forced downwardly. This promotes positive frictional engagement of the bag by the support rolls.

The apparatus may also include means for severing each bag advanced through the gap transversely of the axis of such bag. Such severing or cutting means may include means for advancing each bag discharged from the gap laterally of the axis of elongation of such bag so that the bag moves along a predetermined path and encounters one or more knives fixed to the frame of the apparatus. The bag advancement means may include sets of cutting rolls defining nips adjacent the knives and means for rotating the cutting rolls to draw the bags through such nips.

If each bag is severed transversely of its axis of elongation at a plurality of points along its length prior to discharge of such bag from the apparatus onto the belt conveyor, only short bag segments will be discharged onto the conveyor belt. Thus, the problems described above associated with randomly piled long bags on the conveyor belt can be eliminated. Even if the relatively short bag segments are randomly deposited on the belt conveyor, they generally will not extend beyond the lateral margins of the conveyor belt. Moreover, such short bag segments readily can be handled on a conveyor which incorporates a right angle bend. Such short bag segments can be stacked within the storage container without creating any substantial void spaces within the container. Therefore, the frequency of storage container changes can be reduced significantly.

Other objects, features and advantages of the present invention will be more readily apparent from the detailed description of the preferred embodiment set forth below when read in conjunction with the accompanying drawings.

DETAILED DESCRIPTION OF A PREFERRED EMBODIMENT

Figure 1:
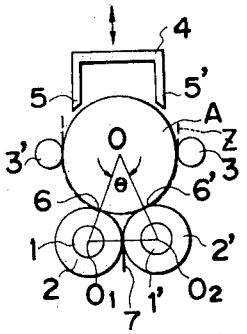
FIG. 1 is a schematic, fragmentary view of a conventional bag removal apparatus.
Figure 3:
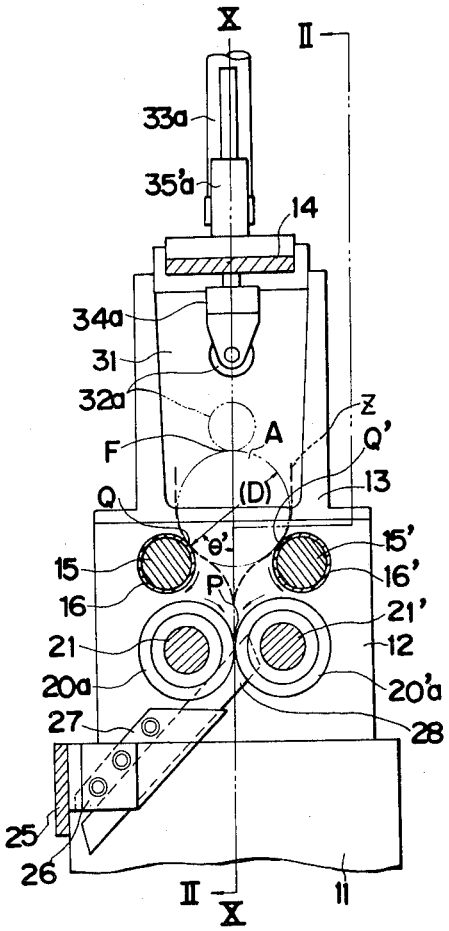
PRIOR ART FIG. 3
FIG. 3 is a fragmentary, sectional view taken along the line III—III in FIG. 2.
Figure 2:
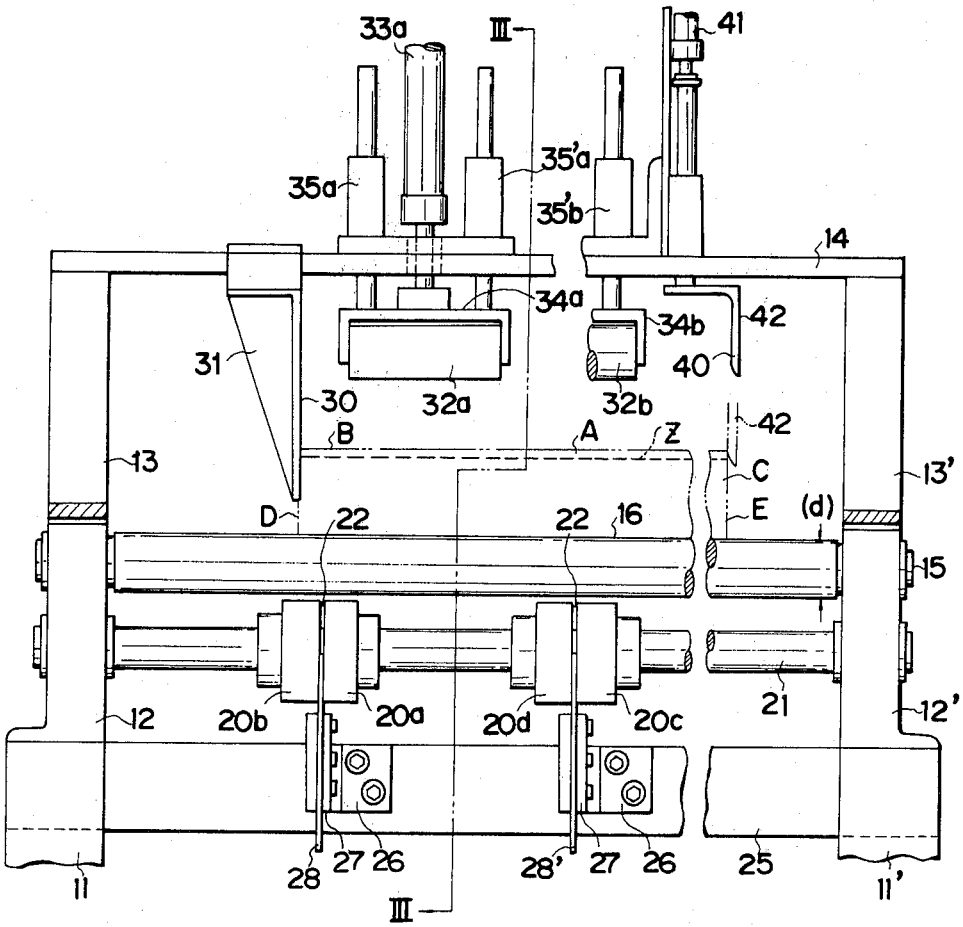
FIG. 2 is a schematic, fragmentary, partially sectional view of apparatus, taken along line II—II in FIG. 3, according to an embodiment of the present invention.

Apparatus according to an embodiment of the present invention is schematically illustrated in FIGS. 2 and 3. The apparatus includes a frame having a pair of opposed base components 11 and 11' remote one from the other, and a pair of bearing components 12 and 12' mounted atop the base components. Top sections 13 and 13' are mounted on bearing components 12 and 12' and a top plate 14 spans and is supported by top sections 13 and 13'.

Two elongated cylindrical support rolls 15 and 15' are rotatably mounted in bearing components 12 and 12' of the frame. The support rolls are arranged substantially horizontally and parallel to one another. The surface of support roll 15 is covered with a layer 16 of resilient, high-friction material, and support roll 15' has a similar covering layer 16'. As best illustrated in FIG. 3, the support rolls are remote from one another so that they define a gap therebetween, i.e., a nipless passage, with the vertical plane X—X being the medial plane of the gap. That is, plane X—X is equidistant from both support rolls. Appropriate means (not shown) are provided for rotating the support rolls in the directions indicated by the arrows adjacent the support roll in FIG. 3. Support roll 15 can be rotated in the clockwise direction as seen in FIG. 3 and support roll 15' can be rotated in the counterclockwise direction, the two support rolls being of equal diameter.

A pair of cutting roll shafts 21 and 21' also are mounted in bearing components 12 and 12' so that the cutting roll shafts extend parallel to one another and parallel to support rolls 15 and 15', the cutting roll shafts being disposed beneath the support rolls. The two cutting roll shafts are arranged on opposite sides of medial plane X—X and at equal distances from such plane. Several cutting roll assemblies are provided, each such cutting roll assembly including four nip defining cutting rolls 20 arranged in two pairs. One cutting roll assembly includes a first pair of cutting rolls **20*a* and 20'*a* (FIG. 3), roll 20*a* being mounted on shaft 21 and roll 20'*a* being mounted on opposite cutting roll shaft 21' so that the two rolls 20*a* and 20'*a* of the first pair define a first nip P therebetween at medial plane X—X. The roll assembly also includes a second pair of cutting rolls, of which only one (roll 20*b*) is visible in FIG. 2. The rolls of the second pair are arranged similarly to the rolls of the first pair so that the rolls of the second pair also define a nip at medial plane X—X. Thus, cutting roll 20*b* is mounted on shaft 21 and the opposing cutting roll (not shown) is mounted on shaft 21'. Roll 20*b* of the second pair is coaxial with roll 20*a* of the first pair and the other roll of the second pair is coaxial with roll 20'*a* of the first pair. As best seen in FIG. 2, the rolls of the second pair are spaced axially along the cutting roll shafts from the rolls of the first pair in the same roll assembly. Thus, there is an axial clearance 22 between roll 20*a* of the first pair and roll 20*b* of the second pair and there is a similar axial clearance between roll 20'*a* (FIG. 3) and the roll of the second pair (not shown) mounted to shaft 21' in alignment with roll 20*b***.

A knife 28 is associated with the cutting roll assembly described above. Knife 28 is mounted to the frame of the apparatus by a support member 27 and an L-shaped bracket 26 which is connected to a knife-support rail 25, knife-support rail 25 in turn being connected to frame base components 11 and 11'. Knife 28 extends into the clearances between the rolls of the roll assembly. As best seen in FIG. 3, knife 28 extends slightly beyond medial plane X—X so that the cutting edge of the knife is disposed adjacent the nips defined by the rolls of the roll assembly. As viewed in FIG. 3, the first nip P defined by rolls **20*a* and 20'*a* of the first pair of rolls in the cutting roll assembly is immediately in front of knife 28** and the second nip (not shown) is immediately behind the knife. The cutting edge of the knife faces upwardly.

Additional cutting roll assemblies and knives similar to the cutting roll assembly and knife described above are provided. One such additional cutting roll assembly includes rolls **20*c* and 20*d* (FIG. 2) knife 28' being associated with such additional cutting roll assembly. Although only two cutting roll assemblies are illustrated in FIG. 2, the apparatus may include more than two cutting roll assemblies and more than two knives. For example, in apparatus utilized for processing bags about 90 cm. long, five cutting roll assemblies and five knives may be provided. The rolls of all of such assemblies are mounted on shafts 21 and 21'**.

An end guide 31 is fixed to top plate 14 so that the guide is disposed above support rolls 15 and 15' adjacent one end of the apparatus. Guide 31 has a flat, vertical surface 30 facing towards the opposite end of the apparatus (towards the right as seen in FIG. 2). A moveable end guide 42 is disposed above the support rolls adjacent the end of the apparatus opposite from fixed end guide 31. Guide 42 is mounted to the piston rod of a fluid operable cylinder 41, the body of cylinder 41 being mounted to top plate 14 of the frame. Cylinder 41 can be operated to move guide 42 vertically between the position illustrated in solid lines in FIG. 2 and the position partially illustrated in broken lines. Guide 42 has a flat, vertical surface 40 which faces towards fixed end guide 31.

Two pressure rolls 32*a* and 32*b* are disposed above support rolls 15 between guides 31 and 42. Roll 32*a* is mounted to roll carrier 34*a* so that such roll can rotate about its own axis relative to the carrier. Carrier 34*a* is slideably mounted to top plate 14 of the frame by means of a pair of rods extending through tubular guides 35*a* and 35′*a* which are fixed to the top plate. The guides, rods and roll carrier are arranged so that the axis of roll 32*a* is parallel to the support rolls. As best seen in FIG. 3, roll 32*a* is disposed in medial plane X—X. The body of a fluid operable cylinder 33*a* is fixed to frame top plate 14, the piston rod of such cylinder being connected to roll carrier 34*a* so that cylinder 33*a* can be operated to move roll carrier 34*a* and roll 32*a* vertically between the position illustrated in solid lines and the position illustrated in broken lines in FIG. 3. The other pressure roll 32*b* (FIG. 2) is supported by a roll carrier 34*b* and a set of rods and guides including guide 35*b*′, such guides and rods being arranged similarly to the guides and rods utilized with roll 32*a*. Roll 32*b* is disposed in medial plane X—X and parallel to the support rolls. A fluid operable cylinder (not shown) is provided for moving roll 32*b* up and down.

In operation, a bag Z with article A enclosed therein is placed atop the support rolls. Prior to placement on the support rolls, the bag Z is slit longitudinally, and this slit is positioned at the top when the bag is placed on the support rolls. The end face D of bag Z at left end portion B of the bag is positioned in contact with vertical surface 30 of fixed guide 31. Cylinder 41 is actuated to lower moveable guide 42 to the position illustrated in broken lines in FIG. 2 so that surface 40 of guide 42 contacts end face E of bag Z at right end portion C of the bag. Thus, the bag and enclosed article are restrained by the guides against axial movement along the support rolls.

Pressure rolls 32*a* and 32*b* are then lowered until the pressure rolls bear on the top (F) of the article and urge the article downwardly against the support rolls 15 and 15′ (FIG. 3). Because the bag Z encompasses the lower portions of the article, A, the bag is engaged between the article and the support rolls along contact lines Q and Q′, seen in end view in FIG. 3. The angle between an imaginary plane connecting contact line Q with the center line of cylindrical article A and medial plane X—X is indicated by $\theta'$ and such angle is referred to herein as a "contact angle". There is an equal but opposite contact angle (not shown) between the imaginary plane connecting contact line Q′ with the center of the article and medial plane X—X.

It is believed that the contact angles contribute to a wedging action which occurs when the pressure rolls urge the article downwardly against the support rolls. Such wedging action can best be understood by considering the equilibrium of forces acting on the article while the pressure rolls are acting on the article. The support rolls apply reaction forces to the article through the bag, but these are not directed vertically. Rather, each such reaction force is directed at the contact angle. Such reaction forces cause the bag to be frictionally engaged by the support rolls at the contact lines Q and Q′. And the magnitude of the reaction forces applied by the support rolls increase as the contact angles increase. To assure adequate reaction forces for sufficient frictional engagement at the contact lines, the contact angles should each be at least 30°. Contact angles in excess of 60° are not preferred because the reaction forces which can be generated with such contact angles may be so great as to cause bending of the support rolls or damage to the article. Moreover, when contact angles in excess of 60° are utilized, the article may fall between the support rolls. Contact angles of between about 40° and about 50° are preferred, and contact angles of about 50° each are most preferred. Of course, the distance between the support rolls necessary to provide the desired contact angle will vary with the size of the article to be processed and the size of the support rolls. The diameter (d) of each support roll inclusive of its covering is preferably about one half the diameter (D) of the bag, i.e., about one half the diameter (D) of the article. The spacing between the rolls required to produce the desired contact angles can be determined by trigonometry. If the bags and articles to be processed are about 8 cm. in diameter and each support roll is about 4 cm. in diameter, then the approximate relationships set forth in Table I apply:

TABLE I

| CONTACT ANGLE ($\theta'$) | DISTANCE FROM MEDIAL PLANE OF GAP TO CENTER LINE OF SUPPORT ROLL | DISTANCE BETWEEN SUPPORT ROLL CENTERLINES | GAP WIDTH |
|---|---|---|---|
| 30° | 3.00 cm. | 6.00 cm. | 2.00 cm. |
| 40° | 3.85 cm. | 7.70 cm. | 3.70 cm. |
| 50° | 4.60 cm. | 9.20 cm. | 5.20 cm. |
| 60° | 5.20 cm. | 10.40 cm. | 6.40 cm. |

The resilient, high friction coverings 16 and 16′ on the support rolls also assist in maintaining firm frictional engagement between the support rolls and the bag at the contact lines.

While the pressure rolls maintain downward force on the article, the support rolls are rotated in the directions indicated in FIG. 3. Support roll 15 is rotated in the clockwise direction and support roll 15′ is rotated in the counterclockwise direction as shown in the drawing. Such rotation of the support rolls pulls the bag into the gap between the support rolls, thus pulling the bag away from the article. As the bag is pulled away from the article the bag is discharged downwardly through the gap between the support rolls towards the cutting rolls. The bag moves substantially laterally of its axis of elongation as it is discharged from between the rolls. That is, the axis of elongation of the bag is substantially horizontal but the bag is moving generally vertically, substantially parallel to medial plane X—X. The bag may deviate somewhat from such horizontal orientation if the support rolls do not pull the bag away from the article in a precisely uniform manner.

Although the bag may deviate somewhat from a perfectly horizontal orientation as it is fed through the gap between the support rolls, such deviations are minimized by the effective frictional engagement of the support rolls with the bag. Such effective frictional engagement helps to assure that all portions of the bag will be engaged and pulled from the article as the support rollers rotate. Moreover, placement of the rollers remote from one another aids in maintaining such horizontal orientation of the bag. Because there is a clearance between the support rollers, any thick or folded sections of the bag can pass through such clearance without jamming or catching.

As the bag moves downwardly, it encounters the cutting rolls 20 mounted on the cutting roll shafts 21 and 21'. Each pair of cutting rolls engages a portion of the bag and pulls such portion of the bag through the nip defined by such pair of cutting rolls. For example, one portion of the bag will be engaged between rolls 20*a* and 20'*a* illustrated in FIG. 3 and such portion will be pulled through the nip P defined by such cutting rolls. An adjacent portion of the bag will be engaged by roll 20*b* (FIG. 2) and the other cutting roll (not shown) which is engaged therewith. As the bag is engaged by the cutting rolls and pulled into the nips therebetween, it is advanced downwardly along a path coincident with medial plane X—X. The bag retains the aforementioned horizontal orientation during such advancement, that is, as the bag advances downwardly through the nips between the cutting rolls, the longitudinal axis of the bag remains substantially horizontal.

As the bag is advanced in this fashion by the cutting rolls, it encounters the knives 28 and the bag is cut substantially transversely its axis of elongation. The cutting action is facilitated by the arrangement of the rollers in assemblies of four rollers each with one pair of rollers being disposed on each side of the associated knife. Because portions of the bag immediately adjacent each knife on opposite sides thereof are advanced by the cutting rolls, the bag does not crumple as it encounters the knives. The bag segments are discharged from the cutting rolls and drop onto a belt conveyor (not shown) positioned beneath the apparatus.

In apparatus utilized for handling bags about 90 cm. long and about 8 cm. in diameter, five knives and five cutting roll assemblies have been utilized. These cut each bag into six segments, each such segment being about 15 cm. long and about 23 cm. wide. Such segments can be successfully handled on a conveyor belt about 30 cm. wide, such conveyor belt being positioned about 30 cm. below the cutting rolls. The direction of motion of the portion of the conveyor belt adjacent the apparatus should be parallel to the support rolls, and the medial plane of the conveyor belt should be coincident with or closely adjacent the medial plane X—X (FIG. 3) of the apparatus so that the cut segments will fall on the conveyor belt.

The short segments can be successfully handled on the conveyor belt even if they fall at random orientations thereon. Because the segments are short, they do not extend beyond the lateral margins of the conveyor belt and therefore do not catch on other elements of the apparatus.

The short segments can be fed through turns or bends in the conveyor belt without creating difficulties such as may occur when full length bags are fed through such turns or bends. Also, the short pieces can be efficiently piled within a storage container at the downwstream end of the conveyor belt without significant voids in such pile. Therefore, each such storage container can generally hold the residue from more bags than would be the case if the bags were piled in the container without being cut into pieces.

As will be readily appreciated, numerous variations and combinations of the features described above can be utilized without departing from the spirit of the present invention. Merely by way of example, the size of the apparatus and the number of knives and cutting roll assemblies provided may vary depending on the size of the bags and articles to be processed. Accordingly, the foregoing description of the preferred embodiments should be understood by way of illustration rather than by way of limitation of the present invention as set forth in the claims.

What is claimed is:

1. Apparatus for removing an elongated bag having a longitudinal slit from an article enclosed in such bag, said apparatus comprising:

(a) a frame;

(b) a pair of elongated support rolls mounted to said frame for receiving said bag with said article therein and contiguously supporting same to preclude movement of said article beyond said rolls, said rolls being substantially horizontal and being spaced from one another to define a nipless passage therebetween;

(c) means for urging said article downwardly to engage portions of said bag with said support rolls;

(d) means for rotating said support rolls relative to said frame in opposite directions to draw said bag from said article and advance it through such nipless passage; and (e) nip-defining roller means supported by said frame downwardly of said nipless passage and non-contiguous with respect to said article for advancing said bag from said nipless passage.

2. Apparatus as claimed in claim 1 in which said rolls are of equal diameter.

3. Apparatus as claimed in claim 2 in which the width of said nipless passage is between about 0.5 to about 1.6 times the diameter of said rolls.

4. Apparatus as claimed in claim 3 in which the width of said nipless passage is between about 3.7 cm. and about 5.2 cm.

5. Apparatus as claimed in claim 4 in which the width of said nipless passage is about 5.2 cm.

6. Apparatus as claimed in claim 1 in which each of said rolls defines a contact angle between about 30° and about 60°.

7. Apparatus as claimed in claim 6 in which each of said contact angles is between about 40° and about 50°.

8. Apparatus as claimed in claim 7 in which each of said contact angles is about 50°.

9. Apparatus as claimed in claim 1 further comprising means for cutting the bag into pieces after its advancement through said nipless passage.

10. Apparatus as claimed in claim 9 in which said bag cutting means is operative to sever the bag substantially transversely of its axis of elongation.

11. Apparatus as claimed in claim 10 in which said bag cutting means is operative to sever the bag at a plurality of locations along its length.

12. Apparatus as claimed in claim 11 in which said nip-defining roller means advances the bag laterally of its axis of elongation along a predetermined path, said apparatus further including a plurality of knives fixed to said frame and projecting into said path, said knives being remote from one another so that said knives will engage the bag at longitudinally spaced locations thereon.

13. Apparatus as claimed in claim 12 in which said nip-defining roller means includes a plurality of roll assemblies, one such roll assembly being associated with each of said knives, each such roll assembly including a first pair of cutting rolls defining a first nip therebetween adjacent the cutting edge of the associated knife, said apparatus also including means for rotating such cutting rolls.

14. Apparatus as claimed in claim 13 in which each of said roll assemblies includes a second pair of cutting rolls defining a second nip therebetween, the second nip of each such assembly being aligned with the first nip of such assembly, each knife extending between the first and second nips of the associated roll assembly, said cutting roll rotating means being operative to rotate said second rolls.

15. Apparatus as claimed in claim 14 further including a pair of cutting roll shafts mounted to said frame, said cutting roll shafts being horizontally disposed beneath said support rolls, one roll of each of said pairs of cutting rolls being mounted to one of said cutting roll shafts, the other roll of each such pair being mounted to the other one of said cutting roll shafts.

16. Apparatus for removing an elongated bag having a longitudinal slit from an article enclosed in such bag, said apparatus comprising:

(a) a frame;

(b) a pair of elongated support rolls mounted to said frame for receiving said bag with said article therein and contiguously supporting same to preclude movement of said article beyond said rolls, said rolls being substantially horizontal and being spaced from one another to define a nipless passage therebetween;

(c) means for urging said article downwardly to engage portions of said bag with said support rolls;

(d) means for rotating said support rolls relative to said frame in opposite directions to draw said bag from said article and advance it through such nipless passage;

(e) A plurality of nip-defining cutting roller assemblies supported by said frame downwardly of said nipless passage and non-contiguous with respect to said article for advancing said bag from said nipless passage; and (f) A plurality of bag cutting knives, each such knife being supported by said frame to sever said bag transversely of its axix of elongation as it is advanced by said cutting roll assemblies.

* * * * *